US009865949B2

(12) United States Patent
Kitagawa et al.

(10) Patent No.: US 9,865,949 B2
(45) Date of Patent: Jan. 9, 2018

(54) ELECTRONIC DEVICE AND CONNECTOR

(71) Applicants: DENSO CORPORATION, Kariya, Aichi-pref. (JP); SUMITOMO WIRING SYSTEMS, LTD., Yokkaichi, Mie-pref. (JP); HONDA MOTOR CO., LTD., Tokyo (JP)

(72) Inventors: Yoshihiro Kitagawa, Kariya (JP); Kenji Morizumi, Wako (JP); Satoki Watanabe, Wako (JP)

(73) Assignees: DENSO CORPORATION, Kariya (JP); SUMITOMO WIRING SYSTEMS, LTD., Mie (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/138,522

(22) Filed: Apr. 26, 2016

(65) Prior Publication Data

US 2016/0322721 A1 Nov. 3, 2016

(30) Foreign Application Priority Data

Apr. 28, 2015 (JP) ..... 2015-091256
Apr. 21, 2016 (JP) ..... 2016-085418

(51) Int. Cl.
*H01R 12/58* (2011.01)
*H01R 12/71* (2011.01)
*H01R 12/72* (2011.01)

(52) U.S. Cl.
CPC ..... *H01R 12/724* (2013.01); *H01R 12/58* (2013.01); *H01R 12/716* (2013.01)

(58) Field of Classification Search
CPC ... H01R 12/724; H01R 12/716; H01R 12/585
See application file for complete search history.

(56) References Cited

U.S. PATENT DOCUMENTS 5,032,085 A * 7/1991 Alwine ..... H01R 12/712 439/79
5,447,454 A 9/1995 Inaba et al.
(Continued)

FOREIGN PATENT DOCUMENTS

JP H06-333626 A 12/1994
JP 2007-311152 A 11/2007
JP 2012-022965 A 2/2012

*Primary Examiner* — Edwin A. Leon
*Assistant Examiner* — Oscar C Jimenez
(74) *Attorney, Agent, or Firm* — Posz Law Group, PLC

(57) ABSTRACT

An electronic device has a base plate and a connector. Multiple terminals are supported by a connector housing, wherein each front-side end of the terminals outwardly extends from a front-side surface and each back-side end of the terminals outwardly extends from a back-side surface of the connector housing and connected to a corresponding land formed in the base plate. The multiple terminals are arranged in a width direction and divided into at least a first and a second terminal group in a height direction of the connector housing. The connector housing has a first and a second step surface on its back side. The terminal of the first terminal group outwardly extends from the first step surface and the terminal of the second terminal group outwardly extends from the second step surface. The first step surface is located at a position closer to the base plate in the height direction than the second step surface. A projecting terminal length of the terminal of the second terminal group in a depth direction of the connector housing is made to be equal to or smaller than that of the terminal of the first terminal group.

18 Claims, 7 Drawing Sheets

(56) References Cited

U.S. PATENT DOCUMENTS

| | | | | | |
|---|---|---|---|---|---|
| 5,593,307 | A * | 1/1997 | Bale | H01R 12/724 | 439/567 |
| 5,676,554 | A * | 10/1997 | Tsuji | H01R 12/724 | 439/79 |
| 5,827,077 | A * | 10/1998 | Fukuda | H01R 12/716 | 439/79 |
| 6,012,930 | A * | 1/2000 | Tokuwa | H01R 12/716 | 439/79 |
| 6,068,494 | A * | 5/2000 | Tokuwa | H01R 12/716 | 439/79 |
| 6,161,283 | A * | 12/2000 | Tokuwa | H01R 12/716 | 29/876 |
| 6,942,504 | B2 * | 9/2005 | Shinozaki | H01R 13/62938 | 439/157 |
| 7,351,097 | B2 * | 4/2008 | Hsu | H01R 13/41 | 439/540.1 |
| 7,367,818 | B2 * | 5/2008 | Sakamoto | H01R 12/725 | 439/607.01 |
| 2005/0118864 | A1 | 6/2005 | Watanabe et al. | | |
| 2008/0108230 | A1 | 5/2008 | Kasai | | |
| 2009/0129035 | A1 * | 5/2009 | Kojima | H05K 5/0052 | 361/752 |
| 2009/0176402 | A1 | 7/2009 | Honda | | |

* cited by examiner

ELECTRONIC DEVICE AND CONNECTOR

CROSS REFERENCE TO RELATED APPLICATION

This application is based on Japanese Patent Applications No. 2015-91256 filed on Apr. 28, 2015 and No. 2016-85418 filed on Apr. 21, 2016, the disclosures of which are incorporated herein by reference.

FIELD OF TECHNOLOGY

The present disclosure relates to an electronic device having a base plate and a connector and, more in particular, relates to the connector itself.

BACKGROUND

An electronic device having a printed, circuit board (a base plate) and a connector is known in the art, for example, as disclosed in Japanese Patent Publication No. 2008-117675. The printed circuit board has multiple lands. The connector has a connector housing and multiple terminals supported by the connector housing. Each of the terminals is outwardly projected from a same terminal projecting surface of the connector housing and respectively connected to a corresponding land of the printed circuit board. The multiple terminals are arranged not only in a width direction of the connector housing but also in a height direction of the connector housing in a multiple-step form.

Each of the terminals is formed in an L-letter shape, which has a first terminal portion, a bent portion and a second terminal portion. The first terminal portion extends in a depth direction of the connector housing and a part of the first terminal portion is supported by the connector housing. The bent portion is connected to a back-side end of the first terminal portion. The second terminal portion extends from the bent portion in a direction to the printed circuit board and is electrically connected to the land.

As one of examples, two groups of the multiple terminals will be further explained, wherein each of first-group terminals and each of second-group terminals are arranged at a same position in the width direction of the connector housing but at different positions in the height direction of the connector housing. In such an example, the bent portion of the second-group terminal is located at a position, which is more separated from the printed circuit board in the height direction than that of the first-group terminal. In addition, the bent portion of the second-group terminal is located at a position of the depth direction of the connector housing, which is perpendicular to the width direction and the height direction, wherein the position of the bent portion of the second-group terminal is more separated in the depth direction away from the connector housing than that of the bent portion of the first-group terminal.

It is further known in the art that the above terminals may resonate with outside vibrations, for example, vibration of an internal combustion engine, vibration of a transmission apparatus of a vehicle and so on. Whether the terminal easily and/or strongly resonates with such outside vibration or not depends on an exposed length of the terminal, which is exposed to an outside of the connector housing. The exposed length of the terminal corresponds to a distance from a terminal projecting surface (a back-side surface) of the connector housing to the land of the printed circuit board. More exactly, the exposed length of the terminal is a sum of a projecting length and a connecting length of the terminal.

The projecting length corresponds to a length of the first terminal portion between the terminal projecting surface of the connector housing and the bent portion of the terminal, while the connecting length corresponds to a length of the second terminal portion between the bent portion and the land of the printed circuit board.

In the above structure, the exposed length of the first-group terminal is smaller than that of the second-group terminal. More exactly, not only the projecting length of the first-group terminal is smaller than that of the second-group terminal, but also the connecting length of the first-group terminal is smaller than that of the second-group terminal.

As a result, even in a case that the exposed length of one of the first-group and the second-group terminals is designed so as not to resonate with the outside vibrations, the exposed length of the other terminal may have such a value that the terminal may resonate with the outside vibrations. Accordingly, it is difficult to design the exposed length of the first-group and the second-group terminals in such a way that neither the first-group terminal nor the second-group terminal may resonate with the outside vibrations.

The second-group terminal can be so modified that the exposed length of the second-group terminal becomes almost equal to that of the first-group terminal. For example, in the above case, the bent portion of the second-group terminal is located at a position, which is closer to the terminal projecting surface of the connector housing in its depth direction than that of the first-group terminal. Then, the projecting length of the second-group terminal can be made smaller than that of the first-group terminal, and thereby the exposed length of the second-group terminal becomes almost equal to that of the first-group terminal. However, according to such a modification, it is not possible to arrange the first-group and the second-group terminals at the same position in the width direction of the connector housing. In other words, the connector housing inevitably becomes larger in the width direction. Namely, a connector size is increased.

SUMMARY OF THE DISCLOSURE

The present disclosure is made in view of the above problem. It is an object of the present disclosure to provide an electronic device and a connector having multiple terminals, according to which an exposed length of the terminal is made to be almost equal to one another without increasing a size of the connector.

According to one of features of the present disclosure, an electronic device comprises;

a base plate having multiple lands; and a connector for electrically connecting the base plate to an outside electric device, which is located at an outside of the electronic device.

The connector has a connector housing and multiple terminals supported by the connector housing, wherein each one end of the terminals outwardly extends from a side surface of the connector housing, and wherein each one end of the terminals is electrically connected to a corresponding land formed in the base plate.

The multiple terminals are arranged in a first direction (for example, a width direction Y) of the connector housing and the multiple terminals are divided into at least a first terminal group and a second terminal group, which are arranged in a second direction (for example, in a height direction Z) of the connector housing, wherein the second direction is perpendicular to the first direction.

Each of the terminals has;

a first terminal portion extending in a third direction (for example, a depth direction X) of the connector housing, which is perpendicular to the first direction and the second direction, wherein a part of the first terminal portion is supported by the connector housing;

a bent portion connected to an end of the first terminal portion; and a second terminal portion extending from the bent portion to the corresponding land of the base plate.

The connector housing has;

a first terminal supporting body for supporting the terminals of the first terminal group; and a second terminal supporting body for supporting the terminals of the second terminal group, wherein the first terminal supporting body has a first step surface from which each of the terminals of the first terminal group outwardly extends, and the second terminal supporting body has a second step surface from which each of the terminals of the second terminal group outwardly extends, and wherein the first step surface is located at a position closer to the base plate in the second direction than the second step surface.

The bent portion of the terminal of the second terminal group is located at a position of the third direction, which is more away from the first step surface of the connector housing in the third direction than the bent portion of the terminal of the first terminal group.

A second projecting terminal length of the terminal of the second terminal group between the second step surface and the bent portion is equal to or smaller than a first projecting terminal length of the terminal of the first terminal group between the first step surface and the bent portion.

According to the above feature of the present disclosure, the bent portion of the terminal belonging to the second terminal group is located at the position, which is more separated from the base plate in the second direction than the bent portion of the terminal belonging to the first terminal group. In addition, the bent portion of the terminal belonging to the second terminal group is located at the position, which is more away from the first step surface of the connector housing in the third direction than that of the terminal belonging to the first terminal group.

As a result, it is possible to locate the terminal of the first terminal group and the terminal of the second terminal group at the positions, which are on the same line extending in the second direction when viewed them in the third direction. It is, therefore, possible to prevent the size of the connector housing from becoming larger in the first direction.

In addition, according to the above features of the present disclosure, the second step surface is located at the position, which is closer to the bent portion of the terminal of the second terminal group than the first step surface. Accordingly, the second projecting terminal length of the terminal of the second terminal group between the second step surface and the bent portion of the same terminal can be made equal to or smaller than that of the terminal of the first terminal group. As a result, the exposed terminal length of the terminal of the second terminal group between the second step surface and the base plate can be made to be almost equal to that of the terminal of the first terminal group.

According to another feature of the present disclosure, a connector is applied to an electronic device, which has a base plate having multiple lands.

The connector has;

a connector housing; and multiple terminals supported by the connector housing, each one end of the terminals outwardly extending from a side surface of the connector housing and each one end of the terminals being electrically connected to a corresponding land.

The multiple terminals are arranged in a first direction (for example, a width direction Y) of the connector housing and the multiple terminals are divided into at least, a first terminal group and a second terminal group, which are arranged in a second direction (for example, a height direction Z) of the connector housing, wherein the second direction is perpendicular to the first direction.

Each of the terminals has;

a first terminal portion extending in a third direction (for example, a depth direction X) of the connector housing, which is perpendicular to the first direction and the second direction, wherein a part of the first terminal portion is supported by the connector housing;

a bent portion connected to an end of the first terminal portion; and a second terminal portion extending from the bent portion to the corresponding land of the base plate.

The connector housing has a first terminal supporting body for supporting the terminals of the first terminal group and a second terminal supporting body for supporting the terminals of the second terminal group. The first terminal supporting body has a first step surface from which each of the terminals of the first terminal group outwardly extends. The second terminal supporting body has a second step surface from which each of the terminals of the second terminal group outwardly extends. The first Step surface is located at a position closer to the base plate in the second direction than the second step surface.

The bent portion of the terminal of the second terminal group is located at a position of the third direction, which is more away from the first step surface of the connector housing in the third direction than the bent portion of the terminal of the first terminal group.

A second projecting terminal length of the terminal of the second terminal group between the second step surface and the bent portion is equal to or smaller than a first projecting terminal length of the terminal of the first terminal group between the first step surface and the bent portion.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
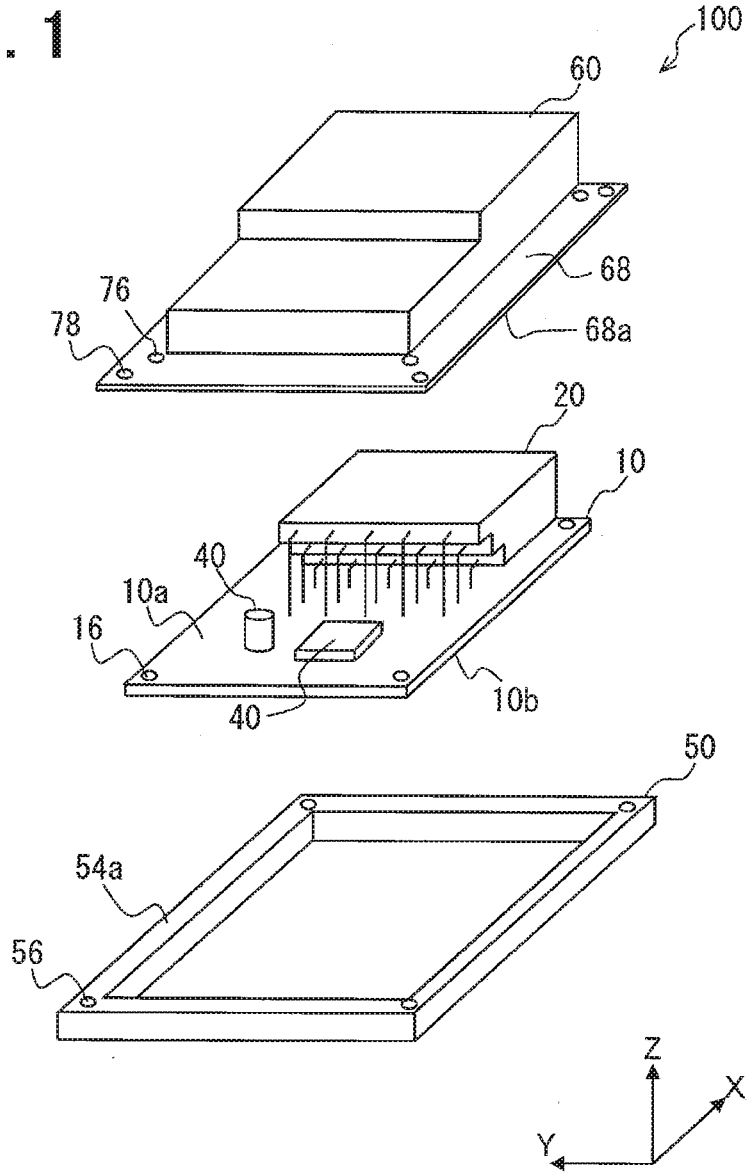
FIG. 1 is a schematic exploded perspective view showing a structure of an electronic device according to a first embodiment of the present disclosure.

The present disclosure will be explained hereinafter by way of multiple embodiments with reference to the drawings. The same reference numerals are given to the same or similar structures and/or portions throughout the embodiments in order to avoid repeated explanation.

In the drawings, a height direction of a connector housing is referred to as a Z-direction, a depth direction is referred to as an X-direction and a width direction is referred to as a Y-direction, wherein each of the X-direction, the Y-direction and the Z-direction is perpendicular to each of the other two directions. In addition, the X-direction corresponds to a third direction, the Y-direction corresponds to a first direction and the Z-direction corresponds to a second direction.

A plane formed by the X-direction and the Y-direction is referred to as an X-Y plane, a plane formed by the Y-direction and the Z-direction as referred to as a Y-Z plane and a plane formed by the Z-direction and the X-direction is referred to as a ZX plane.

First Embodiment

A structure of an electronic device 100 according to a first embodiment of the present disclosure will be explained with reference to FIGS. 1 and 2. In FIG. 1, a cover member 60, a base plate 10 and a casing 50, which are major components of the electronic device 100, are dis-assembled in the Z-direction for the purpose of showing the structure of the electronic device 100 for a better understanding.

The electronic device 100 has the base plate 10 and a connector 20. In the present embodiment, the electronic device 100 further has multiple electronic parts and components 40, the casing 50 and the cover member 60. The electronic device 100 is, for example, an electronic control unit (ECU) for a vehicle.

The base plate 10 has multiple through-holes 12, multiple lands 14 and multiple insertion holes 16. In the present embodiment, the base plate 10 is composed of a printed circuit board. A planar shape of the base plate 10 in the X-Y plane is an almost rectangular shape.

Each of the through-holes 12 is so formed in the base plate 10 as to extend from an upper-side surface 10*a* (a first surface 10*a*) of the base plate 10 to a lower-side surface 10*b* (a second surface 10*b*) of the base plate 10, which is formed on an opposite side to the upper-side surface 10*a*. Each of the lands 14, which is formed on the surfaces of the base plate 10 at each of the through-holes 12, works as an electrode of the base plate 10. The land 14 is made of metallic material. Each of the lands 14 is composed of a side-surface portion formed at an inner side surface of the through-hole 12, a first-surface portion formed on the upper-side surface 10*a* and a second-surface portion formed on the lower-side surface 10*b*. The side-surface portion, the first-surface portion and the second-surface portion of the land 14 are connected to one another.

Each of the insertion holes 16 is formed for the purpose of fixing the base plate 10 to the cover member 60. The insertion hole 16 is formed in the base plate 10 so as to extend from the upper-side surface 10*a* to the lower-side surface 10*b*. The insertion hole 16 is formed in the base plate 10 at such a portion, where neither the through-holes 12 nor the lands 14 are formed. More exactly, each of the insertion holes 16 is formed at each corner of the base plate 10 having the rectangular planar shape. The connector 20 is located at a position on the upper-side surface 10*a*, which is different from those of the through-holes 12, the lands 14 and the insertion holes 16.

The connector 20 is one of the components of the electronic device 100 for electrically connecting the base plate 10 to outside electric devices (not shown), which are located at an outside of the electronic device 100. The connector 20 is located on the base plate 10 at one of end portions in the X-direction. The connector 20 has a connector housing 22 and multiple terminals 24. The connector housing 22, which supports the multiple terminals 24, is made of, for example, resin.

In the present embodiment, the connector housing 22 is formed in a box shape as a whole and has a closed end portion 26 (hereinafter, a connector body portion 26) and an open end portion at its front side, which is located at an opposite side to the connector body portion 26 in the X-direction. The terminals 24 are supported by the connector body portion 26 of the connector housing 22. An outside connector (not shown) connected to the outside electric device(s) is fitted to the connector housing 22. In the present embodiment, the connector housing 22 is located on the upper-side surface 10*a* of the base plate 10. When the outside connector of the outside electric device(s) is fitted to the connector housing 22, the terminals 24 are electrically connected to the outside electric device(s).

A front-side end (a right-hand end in FIG. 2) of each terminal 24 is located in an open space formed by the connector housing 22 at the open end portion, while a back-side end (a left-hand end in FIG. 2) of the terminal 24 is electrically connected to the corresponding land 14 formed in the base plate 10. For example, the connector 20 is manufactured in such a way that the terminals 24 are formed in the connector housing 22 by an insert-molding method. Alternatively, the connector 20 may be formed by a different method of press-inserting the terminals 24 into the connector housing 22.

The through-hole 12 and the land 14 are formed for each of the terminals 24. Each back-side end of the terminals 24 is inserted into the respective through-hole 12 and electrically connected to the land 14. As above, each of the terminals 24 is mounted to the base plate 10. In the present embodiment, the terminal 24 is soldered to the land 14. A more detailed structure of the connector 20 will be explained below.

The electronic parts and/or components 40 form an electronic circuit together with the base plate 10. The electronic parts and/or components 40 are composed of, for example, a diode, a coil, a capacitor, a resistor, a micro-computer, an ASIC (an application specific integrated circuit) and so on. In the present embodiment, the electronic parts and/or components 40 are mounted to only the upper-side surface 10*a*. The electronic parts and/or components 40 are mounted to the base plate 10 at positions, which are different from those for the through-holes 12, the lands 14 and the insertion holes 16.

The casing 50 is formed in a box shape having an open end. As shown in the drawing, the open end is formed in the casing 50 at its one side in the Z-direction (at its upper side in FIG. 1). The casing 50 is so arranged as to cover the lower-side surface 10*b* of the base plate 10. The casing 50 has a bottom wall portion 52 and a side wall portion 54. The bottom wall portion 52 is formed in a flat plate shape having its thickness direction in the Z-direction. The flat plate shape of the bottom wall portion 52 has an almost rectangular shape. An upper-side surface 52*a* an inside surface 52*a*) of the bottom wall portion 52 is opposed to the lower-side surface 10*b* of the base plate 10 at a predetermined distance.

The side wall portion 54 has four side walls, each of which extends from each side of the rectangular bottom wall portion 52 toward the base plate 10 in the Z-direction. An inner peripheral wall surface as well as an outer peripheral wall surface of the side wall portion 54 forms a rectangular shape on the X-Y plane. The side wall portion 54 surrounds the base plate 10 on the X-Y plane. The side wall portion 54 has an upper-side surface 54*a* at an opposite side to the bottom wall portion 52 in the Z-direction. The upper-side surface 54*a* has a plane perpendicular to the Z-direction. The upper-side surface 54*a* is located at a position of the Z-direction, which coincides with the upper-side surface 10*a* of the base plate 10, as shown in FIG. 2. Multiple screw holes 56 are formed in the side wall portion 54. Each of the screw holes 56 has a predetermined depth from the upper-side surface 54*a*. The casing 50 is screw-fixed to the cover member 60 by means of multiple bolts or the like (not shown).

The cover member 60 forms an inside space 62 together with the connector 20 and the casing 50. The base plate 10 and the electronic parts and/or components 40 are accommodated in the inside space 62. The cover member 60 is located on the upper-side surface 10*a* of the base plate 10, that is, at a position opposite to the casing 50 in the Z-direction. The cover member 60 covers the base plate 10, the connector 20 and the electronic parts and/or components 40. The cover member 60 has an open end (a board-side open end) at its lower side opposed to the base plate 10 in the Z-direction. The cover member 60 has another open end (a connector-side open end) at its front side in the X-direction, as shown in FIG. 2.

The board-side open end of the cover member 60 is closed by the base plate 10 and/or the casing 50. The connector-side open end of the cover member 60 is closed by the connector 20. A part of the connector 20 (a right-hand side portion in FIG. 2) is outwardly projected from the cover member 60, so that the outside connector (not shown) of the outside electric device(s) is fitted into the connector housing 22 of the connector 20.

The cover member 60 has a top wall portion 64, a side wall portion 66 and a flanged portion 68. The top wall portion 64 has a stepped shape on the Z-X plane. The top wall portion 64 is composed of a first cover portion 70, a second cover portion 74 and a connecting portion 72.

The first cover portion 70 is formed in a flat plate shape having its thickness direction in the Z-direction. The flat plate shape of the first cover portion 70 is an almost rectangular shape. The first cover portion 70 is located at a position, which overlaps the connector 20 in the Z-direction. One side end (a left-hand end in FIG. 2) of the first cover portion 70 in the X-direction is connected to the connecting portion 72.

The connecting portion 72 extends from the side end of the first cover portion 70 toward the base plate 10 in the Z-direction. An upper-side end of the connecting portion. 72 in the Z-direction is connected to the side end of the first cover portion 70, while a lower-side end of the connecting portion 72 in the Z-direction (an opposite side end of the connecting portion 72) is connected to one side end (a right-hand end in FIG. 2) of the second cover portion 74.

The second cover portion 74 extends in the X-direction from the lower-side end of the connecting portion 72 toward a direction opposite to the first cover portion 70. The second cover portion 74 is formed in a flat plate shape having its thickness direction in the Z-direction. The second cover portion 74 is located at a position, which overlaps the electronic parts and/or components 40 in the Z-direction. The second cover portion 74 is so arranged as to be closer to the base plate 10 in the Z-direction than the first cover portion 70. The flat plate shape of the second cover portion 74 is an almost rectangular shape. A width of the first cover portion 70, a width of the connecting portion 72 and a width of the second cover portion 74 are identical to one another in the Y-direction.

The side wall portion 66 has three side walls, each of which extends from an outer periphery of the top wall portion 64 in the Z-direction toward the base plate 10. More exactly, each of the side walls of the side wall portion 66 extends from the top wall portion 64 to the upper-side surface 54*a* of the side wall portion 54 of the casing 50. The side wall portion 66 has a further side wall (a fourth side wall), which extends in the Z-direction from the outer periphery of the first cover portion 70 on the side of the connector-side open end, that is an opposite side to the connecting portion 72 in the X-direction. The fourth side wall does not extend to the upper-side surface 54*a* but is terminated at a middle portion in the Z-direction so that the connector-side open end is formed in the cover member 60. The part of the connector 20 is outwardly projected from the connector-side open end of the cover member 60.

The flanged portion 68 extends in a direction perpendicular to the Z-direction from the side wall portion 66. More exactly, the flanged portion 68 extends in a direction opposite to the inside space 62, that is, in an outward direction from the side wall portion 66. The flanged portion 68 is formed by a flat plate having a thickness direction in the Z-direction. A lower-side surface 68*a* of the flanged portion 68 is in contact with the upper-side surface 54*a* of the side-wall portion 54 of the casing 50 and an outer periphery of the upper-side surface 10*a* (the first surface 10*a*) of the base plate 10.

Multiple first fixing holes 76 are formed in the flanged portion 68 at such positions respectively corresponding to the insertion holes 16 of the base plate 10, so that the base plate 10 is fixed to the cover member 60 by bolts or any other fixing means. In other words, each of the first fixing holes 76 overlaps with the corresponding insertion hole 16 in the Z-direction. In addition, multiple second fixing holes 78 are formed in the flanged portion 68 at such positions respectively corresponding to the screw holes 56 of the casing 50, so that the cover member 60 is fixed to the casing 50 by means of screws or any other fixing means. Each of the second fixing holes 78 overlaps with the corresponding screw hole 56 in the Z-direction.

A more detailed structure of the connector 20 will be further explained with reference to FIGS. 2 to 4.

Each of the terminals 24 has a first terminal portion 28, a bent portion 30 and a second terminal portion 32. In the present embodiment, the first terminal portion 28 straightly extends in the X-direction and a part of the first terminal portion 28 is supported by the connector housing 22. In the present embodiment, each end of the first terminal portion 28 is outwardly extending from the connector body portion 26 of the connector housing 22 in opposite directions. In other words, a middle part of the first terminal portion 28 is supported by the connector body portion 26.

Figure 2:
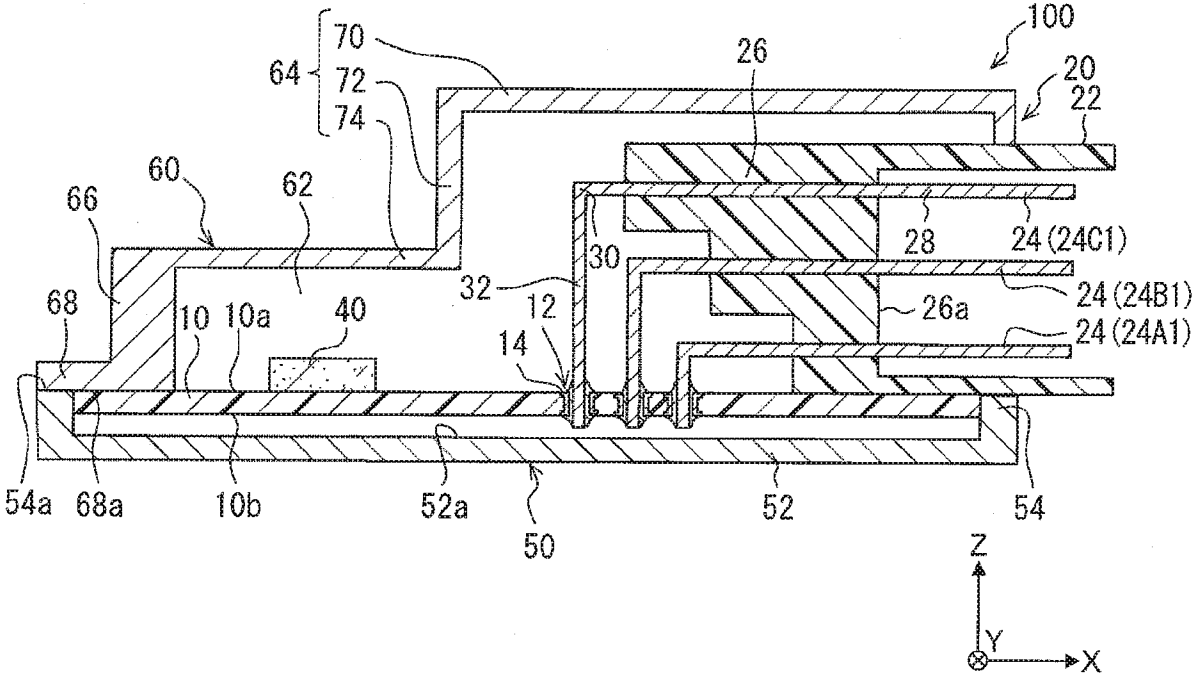
FIG. 2 is a schematic cross sectional view showing relevant portions of the electronic device of FIG. 1.

The connector body portion 26 has a front-side surface 26*a* (an outside terminal projecting surface 26*a*) in the X-direction on a right-hand side in FIG. 2 (at the front side of the connector 20) and a back-side surface (an inside terminal projecting surface) in the X-direction on a left-hand side in FIG. 2 (at the hack side of the connector 20). The back-side surface is composed of a first step surface 26*b*, a second step surface 26*c* and a third step surface 26*d*. Therefore, each front-side end (the right-hand end) of the first terminal, portion 28 is outwardly extending from the front-side surface 26*a*, while each hack-side end (the left-hand end) of the first terminal portion. 28 is outwardly extending from each of the first to the third step surfaces 26*b* to 26*d* of the back-side surface. The right-hand end of the first terminal portion 28, which is outwardly extending from the front-side surface 26*a* and which is referred to as an outside extending portion, is connected to the outside connector (not shown). The front-side surface 26*a* is a surface perpendicular to the X-direction.

The back-side surface (each of the first to the third step surfaces 26*b* to 26*d*), which is a surface of the connector body portion 26 in the X-direction opposite to the front-side surface 26*a*, is exposed to the inside space 62 of the electronic device 100. The left-hand end of the first terminal portion 28 outwardly extending from the back-side surface (each step surface 26*b*/26*c*/26*d*), which is located on the opposite side to the front-side surface 26*a* in the X-direction and which is referred to as an inside extending portion, is connected to the bent portion 30 of the terminal 24. The bent portion 30 corresponds to a portion of the terminal 24 for connecting the first terminal portion 28 and the second terminal portion 32 to each other. In the present embodiment, a bent angle at the bent portion 30 is 90 degrees.

The second terminal portion 32 extends from the bent portion. 30 to the corresponding land 14 formed in the base plate 10. In the present embodiment, the second terminal portion 32 straightly extends in the Z-direction. As above, each of the terminals 24 is formed in the L-letter shape. A forward end of the second terminal portion 32 (a lower end in FIG. 2 or FIG. 4) is inserted into the through-hole 12 and soldered to the land 14.

In the present disclosure, a distance of each terminal 24 between the back-side surface (each of the first to the third step surfaces 26*b*/26*c*/26*d*) and the base plate 10 (the lower end portion of the terminal 24 connected to the land 14) is referred to as "an exposed terminal length". A distance of the inside extending portion of the first terminal portion 28, which is a distance between one of the step surfaces 26*b*/26*c*/26*d* and the bent portion 30 of the terminal 24, is referred to as "a projecting terminal length". A distance of the second terminal portion 32 between the bent portion 30 and the base plate 10 (the lower end portion of the terminal 24 connected to the land 14) is referred to as "a connecting terminal length". Therefore, in the present embodiment, the projecting terminal length corresponds to a component of the exposed terminal length of the terminal 24 in the X-direction, while the connecting terminal length corresponds to a remaining component of the exposed terminal length of the terminal 24 in the Z-direction.

Figure 3:
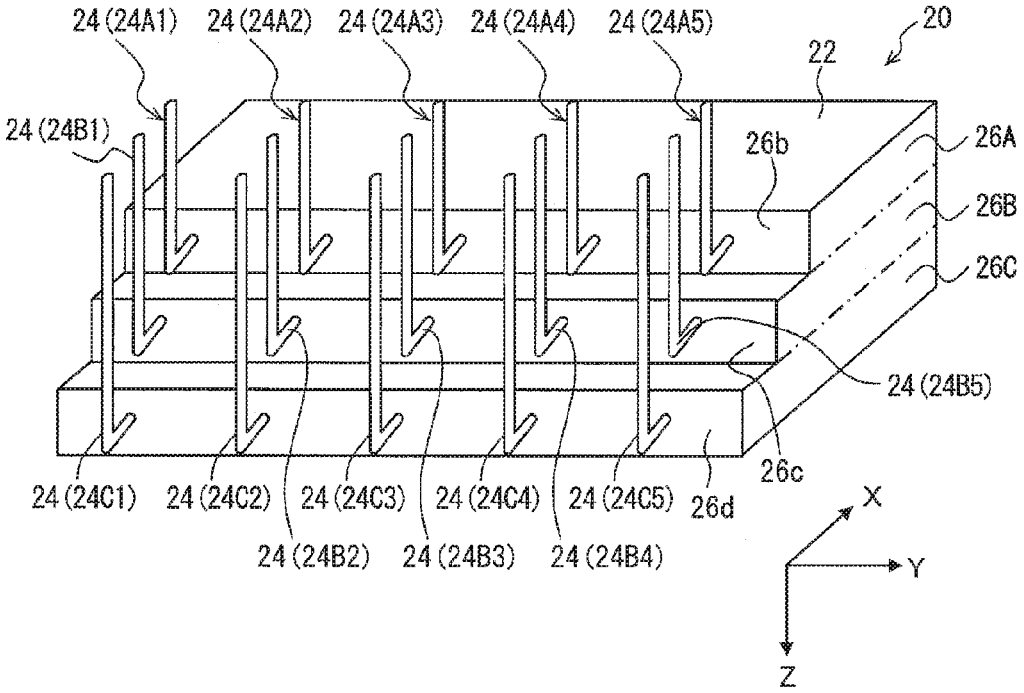
FIG. 3 is a schematic perspective view showing a detailed structure of a connector mounted to the electronic device.

The multiple terminals 24 are arranged in the connector housing 22 in the width direction (the Y-direction=the first direction), as shown in FIG. 3. In addition, a certain number of the terminals 24, which are arranged in a row extending in the Y-direction, form a group of the terminals 24. Multiple groups of the terminals 24 are further arranged in a multi-step manner in the height direction (the Z-direction=the second direction). For example, in the present embodiment (FIG. 3), five terminals 24 are arranged in the Y-direction to form one terminal group and three terminal groups of the terminals 24 are arranged in the Z-direction.

In the present embodiment, the terminal group of a first row, which is closest to the base plate 10 in the Z-direction, is referred to as "a first row group". In FIG. 3, each terminal 24 of the first row group is designated by reference numerals "24A1" to "24A5". Another terminal group of a second row, which is next closer to the base plate 10 in the Z-direction, is referred to as "a second row group". In FIG. 3, each terminal 24 of the second row group is designated by reference numerals "24B1" to "24B5". A further terminal group of a third row, which is most away from the base plate 10 in the Z-direction, is referred to as "a third row group". In FIG. 3, each terminal 24 of the third row group is designated by reference numerals "24C1" to "24C5".

In addition, each of the terminals 24, which belongs to one of the first to the third row groups and which is located at a left-most end of the Y-direction in each of the row groups, forms a first column of the terminals 24. In FIG. 3, the terminals of the first column are respectively indicated by the reference numerals "24A1", "24B1" and "24C1". The terminals 24A1, 24B1 and 24C1 of the first column are located on a line extending in the Z-direction when viewed them in the X-direction (=the third direction).

In a similar manner, the terminals 24 belonging to each of the first to the third row groups and located at a position next to the above terminal 24 of the first column in the Y-direction form a second column of the terminals 24. In FIG. 3, the terminals of the second column are respectively indicated by the reference numerals "24A2", "24B2" and "24C2". The terminals 24A2, 24B2 and 24C2 of the second column are also located on another line extending in the Z-direction when viewed them in the X-direction.

In the same manner to the above terminals of the first column and the second column, the remaining terminal s 24 of each of the row groups respectively form a third column of the terminals 24, a fourth column of the terminals 24 and a fifth column of the terminals 24 from the left-hand side to the right-hand side in the Y-direction in FIG. 3. In FIG. 3, the terminals of the third column are indicated by the reference numerals "24A3" to "24C3", the terminals of the fourth column are indicated by the reference numerals "24A4" to "24C4" and the terminals of the fifth column are indicated by the reference numerals "24A5" to "24C5". The respective terminals 24 included in the same column are likewise located on one line extending in the Z-direction when viewed them in the X-direction.

The bent portion 30 of the terminal 24 (24A1-24A5) belonging to the first row group is located at a position, which is closer to the base plate 10 in the Z-direction than that of the bent portion 30 of the terminal 24 (24B1-24B5) belonging to the second row group or that of the bent portion 30 of the terminal 24 (24C1-24C5) belonging to the third row group. The bent portion 30 of the terminal 24 (24B1-24B5) belonging to the second row group is located at a position, which is closer to the base plate 10 in the Z-direction than that of the bent portion 30 of the terminal 24 (24C1-24C5) belonging to the third row group.

The bent portion 30 of the terminal 24 (24B1-24B5) of the second row group as well as the bent portion 30 of the terminal 24 (24C1-24C5) of the third row group is located at a position, which is more separated from that of the bent portion 30 of the terminal 24 (24A1-24A5) of the first row group in the X-direction away from the connector housing 22. The bent portion 30 of the terminal 24 (24C1-24C5) of the third row group is located at a position, which is further separated from that of the bent portion 30 of the terminal 24 (24B1-24B5) of the second row group in the X-direction away from the connector housing 22.

As explained above, each front-side end of the terminals 24 of the first to the third row groups is outwardly extending from the front-side surface 26*a* of the connector body portion 26, that is, from the opposite side surface to the back-side surface including the first to the third step surfaces 26*b*/26*c*/26*d*. In other words, each of the multiple terminals 24, positions of which are different from one another in the Z-direction, is outwardly extending from the same surface (the front-side surface 26*a*) located on the opposite side to the back-side surface (the first to the third step surfaces 26*b* to 26*d*).

A thickness of the connector body portion 26 in the X-direction differs from a portion to a portion for the respective terminal groups of the terminals 24, which are arranged in the Z-direction. In the present embodiment, a portion of the connector body portion 26 between the front-side surface 26*a* and the first step surface 26*b* for supporting the terminals 24 (24A1-24A5) of the first row group is referred to as "a first terminal supporting body 26A". In a similar manner, another portion of the connector body portion 26 between the front-side surface 26*a* and the second step surface 26*c* for supporting the terminals 24 (24B1-24B5) of the second row group is referred to as "a second terminal supporting body 26B". A further portion of the connector body portion 26 between the front-side surface 26*a* and the third step surface 26*d* for supporting the terminals 24 (24C1-24C5) of the third row group is referred to as "a third terminal supporting body 26C". As shown in FIG. 4, the thickness of each terminal supporting body is respectively defined as a thickness "T1" for the first terminal supporting body 26A, a thickness "T2" for the second terminal supporting body 26B and a thickness "T3" for the third terminal supporting body 26C. In the present embodiment, the thickness "T2" of the second terminal supporting body 26B is made to be larger than the thickness "T1" of the first terminal supporting body 26A. In addition, the thickness "T3" of the third terminal supporting body 26C is made to be larger than the thickness "T2" of the second terminal supporting body 26B.

Figure 4:
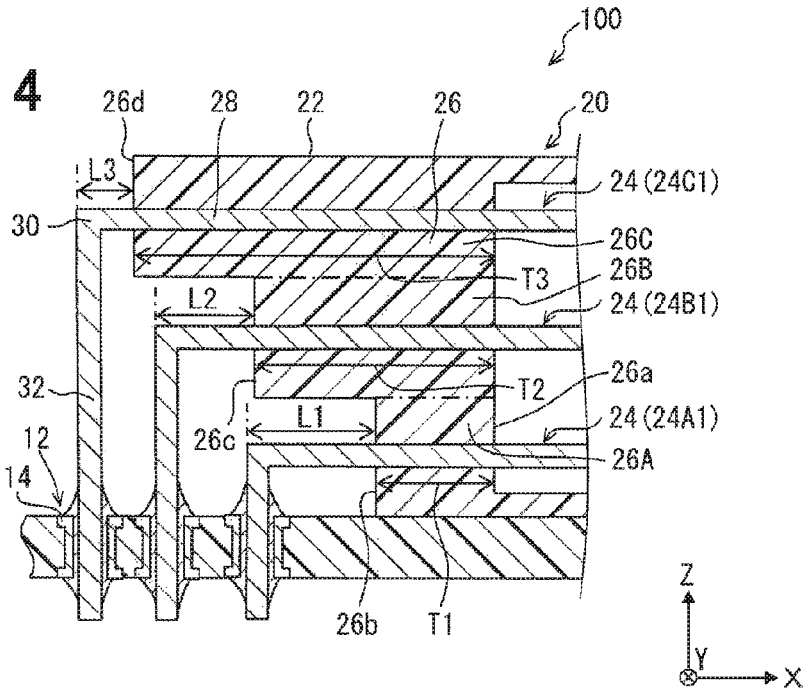
FIG. 4 is an enlarged schematic cross sectional view showing a detailed structure of the connector.
Figure 5:
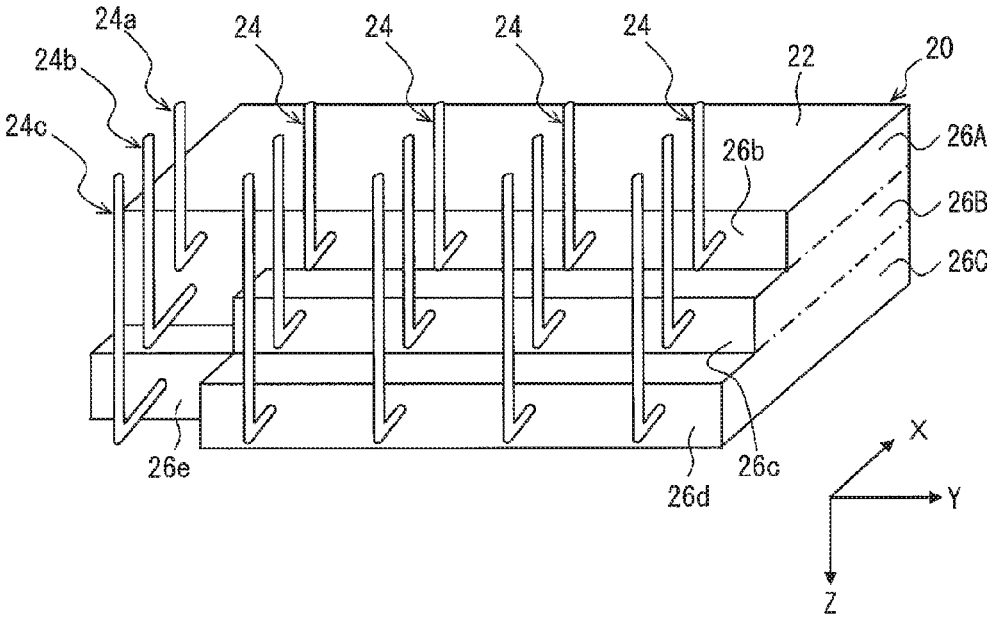
FIG. 5 is a schematic perspective view showing a detailed structure of a connector for an electronic device according to a second embodiment of the present disclosure.
Figure 6:
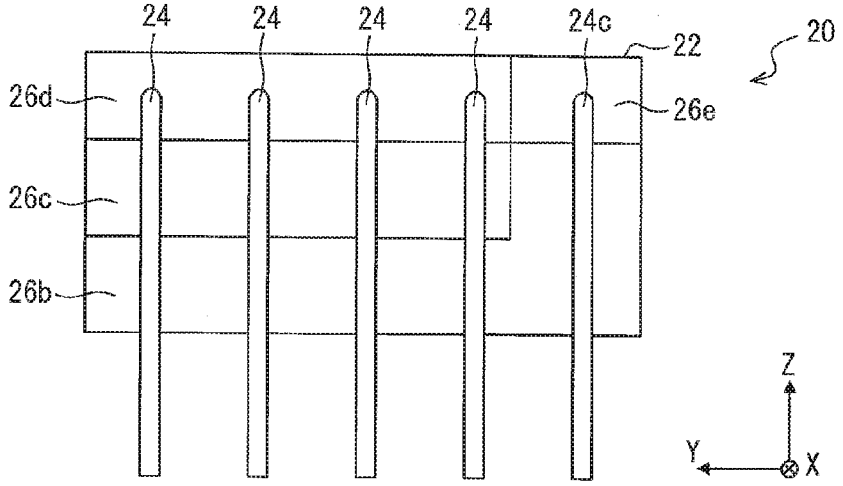
FIG. 6 is a schematic plan view showing the detailed structure of the connector, when viewed it in an X-direction from a left-hand side in FIG. 5 and turned it upside down.

Each of the multiple terminals 24 of the respective row groups, the positions of which are different from one another in the Z-direction, is outwardly extending in the X-direction from the different step surface 26*b*/26*c*/26*d* into the inside space 62 (in the left-hand direction in FIGS. 2 and 4). In other words, each of the multiple terminals 24 of each row group is outwardly extending from the corresponding step surface 26*b*/26*c*/26*d*, each of which is located on the opposite side to the front-side surface 26*a* in the X-direction. More exactly, the terminals 24 (24A1-24A5) of the first row group are outwardly extending from the first step surface 26*b*, the terminals 24 (24B1-24B5) of the second row group are outwardly extending from the second step surface 26*c* and the terminals 24 (24C1-24C5) of the third row group are outwardly extending from the third step surface 26*d*. As already explained above, each of the first to the third step surfaces 26*b* to 26*d* is perpendicular to the X-direction.

Each of the first to the third step surfaces 26*b* to 26*d* is formed at different positions in the X-direction from one another. More exactly, the third step surface 26*d* is located at a position, which is closer to the bent portion 30 of the terminal 24 (24C1-24C5) of the third row group in the X-direction than the first and the second step surfaces 26*b* and 26*c*. In a similar manner, the second step surface 26*c* is located at a position, which is closer to the bent portion 30 of the terminal 24 (24B1-24B5) of the second row group in the X-direction than the first step surface 26*b*. In the present embodiment, the first to the third step surfaces 26*b* to 26*d* are arranged in this order in the Z-direction from the base plate 10, in such a manner that the distance between the front-side surface 26*a* and each of the step surfaces (that is, the thickness of each terminal supporting body) in the X-direction becomes larger in the Z-direction away from the base plate 10. As above, the back-side surface (the first to the third step surfaces 26*b* to 26*d*) of the connector body portion 26 is formed in a step-like shape on the side opposite to the front-side surface 26*a*.

The projecting terminal length between the first step surface 26*b* and the bent portion 30 of the terminal 24 of the first row group is referred to as "a first projecting terminal length L1". The projecting terminal length between the second step surface 26*c* and the bent portion 30 of the terminal 24 of the second row group is referred to as "a second projecting terminal length L2". The projecting terminal length between the third step surface 26*d* and the bent portion 30 of the terminal 24 of the third row group is referred to as "a third projecting terminal length L3".

In the present embodiment, the second projecting terminal length "L2" is made to be equal to or smaller than the first projecting terminal length "L1" and the third projecting terminal length "L3" is made to be equal to or smaller than the second projecting terminal length. "L2". As above, the terminals 24 of the first to the third row groups are arranged in such an order that the respective projecting terminal length (from "L1" to "L3") between the respective step surface and the bent portion of the respective terminal becomes smaller in the Z-direction away from the base plate 10. Each of the first projecting terminal length "L1" to the third projecting terminal length "L3", which corresponds to the length of the inside extending portion, is the component of the exposed terminal length of the terminal 24 in the X-direction.

Advantages of the electronic device 100 and the connector 20 of the present embodiment will be hereinafter explained.

In a first case, in which the terminal 24 (24A1-24A5) of the first row group is compared with the terminal 24 (24B1-24B5) of the second row group (or with the terminals 24 (24B1-24B5, 24C1-24C5) of the second and the third row groups), the position of the terminal 24 (24A1-24A5) of the first row group is different from that of the terminal 24 (24B1-24B5) of the second row group (or the terminals 24 (24B1-24B5, 24C1-24C5) of the second and the third row groups) in the Z-direction. In the first case, the terminal 24 (24A1-24A5) of the first row group is referred to as "a first-group terminal", while the terminal 24 (24B1-24B5) of the second row group or the terminals 24 (24B1-24B5, 24C1-24C5) of the second and the third row groups are collectively referred to as "a second-group terminal".

In a second case, in which the terminal 24 (24B1-24B5) of the second row group s compared with the terminal 24 (24C1-24C5) of the third row group, the position of the terminal 24 (24B1-24B5) of the second row group is different from that of the terminal 24 (24C1-24C5) of the third row group in the Z-direction. In the second case, the terminal 24 (24B1-24B5) of the second row group is referred to as "a first-group terminal", while the terminal 24 (24C1-24C5) of the third row group is referred to as "a second-group terminal".

Then, in the present embodiment (in each of the above first and the second cases), the second-group terminal 24 is located at the position, which is more separated from the base plate 10 in the Z-direction than the first-group terminal 24, in other words, the bent portion 30 of the second-group terminal 24 is located at the position, which is more separated from the base plate 10 in the Z-direction than that of the bent portion 30 of the first-group terminal 24. In addition, the bent portion 30 of the second-group terminal 24 is located at the position, which is more separated from that of the bent portion 30 of the first-group terminal 24 in the X-direction toward the inside space 62 of the electronic device 100 (that is, in the direction opposite to the connector-side open end of the connector housing 22). According to the above structure, it is possible to arrange the first-group terminal 24 and the second-group terminal 24 at respective positions, which are located on the same point in the Y-direction. For example, the terminal 24A1, the terminal 24B1 and the terminal 24C1 of the first column can be located on the same line extending in the Z-direction. As a result, it is possible to prevent the size of the connector housing 22, that is, the size of the connector 20, from becoming larger.

In addition, according to the present embodiment, it is possible to make the projecting terminal length of the second-group terminal 24 equal to or smaller than that of the first-group terminal 24 ("L2 and/or L3<L1" in the first case or "L3<L2" in the second case). According to the above structure, it is possible to make the exposed terminal length of the second-group terminal 24 (for example, the terminals 24B1-24B5) to become almost equal to that of the first-group terminal 24 (for example, the terminals 24A1-24A5). Accordingly, it is much easier to design the exposed terminal length of the first-group and the second-group terminals in such a way that each of the first-group and the second-group terminals 24 does not resonate with the outside vibrations.

Second Embodiment

In a second embodiment of the present disclosure, explanation for those portions of the electronic device 100, which have the same or similar portions and/or structures to those of the first embodiment, will be omitted.

Figure 9:
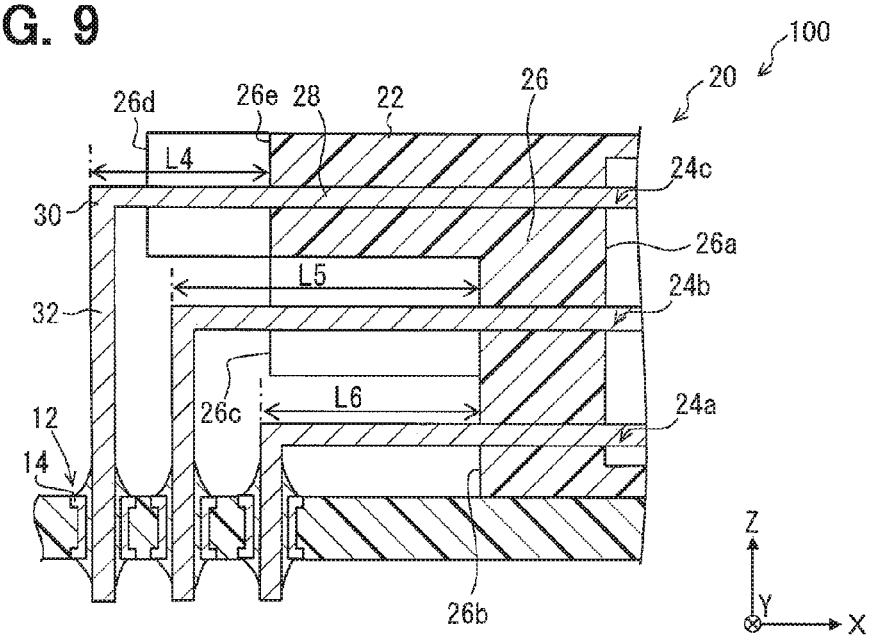
FIG. 9 is an enlarged schematic cross sectional view showing a detailed structure of the connector of the second embodiment.

As shown in FIGS. 5 to 9, structures of the terminals 24 of the first column in each of the first to the third row groups are different from those of the second to the fifth columns of the respective row groups. In the second embodiment, the terminal of the first column in the first row group is designated by a reference numeral 24*a*, the terminal of the first column in the second row group is designated by a reference numeral 24*b*, and the terminal of the first column in the third row group is designated by a reference numeral 24*c*. The remaining terminals 24 of the second to the fifth columns in the first to the third row groups are identical to those of the first embodiment. FIG. 9 shows a cross sectional view showing the terminals 24*a* to 24*c* of the first column.

As shown in FIG. 9, each of the first terminal portions 28 (more exactly, the inside extending portion) of the terminal 24*a* and the terminal 24*b* is outwardly extending from the same back-side surface (the first step surface 26*b*) of the connector body portion 26. The first step surface 26*b*, from which the terminals 24*a* and 24*b* are outwardly extending, is the surface perpendicular to the X-direction.

As above, the back-side surface of the connector body portion 26, from which the inside extending portion of the first terminal portion 28 of the terminal 24*a* is outwardly extending, and the back-side surface of the connector body portion 26, from which the inside extending, portion of the first terminal portion 28 of the terminal 24*b* is outwardly extending, are located on the same plane to the first step surface 26*b*, from which the terminals 24 of the first row group in the second to the fifth columns are outwardly extending in the X-direction. Namely, the back-side surface of the connector body portion 26, from which the terminal 24*a* and the terminal 24*b* are outwardly extending in the X-direction (in the left-hand direction in FIG. 9), coincides with the first step surface 26*a*, from which the terminals 24 of the first row group are outwardly extending in the X-direction. Therefore, it can be re-worded that the first terminal portion 28 of the terminal 24*a* of the first row group in the first column and the first terminal portion 28 of the terminal 24*b* of the second row group in the first column are outwardly extending from the same first step surface 26*b* in the X-direction.

Figure 7:
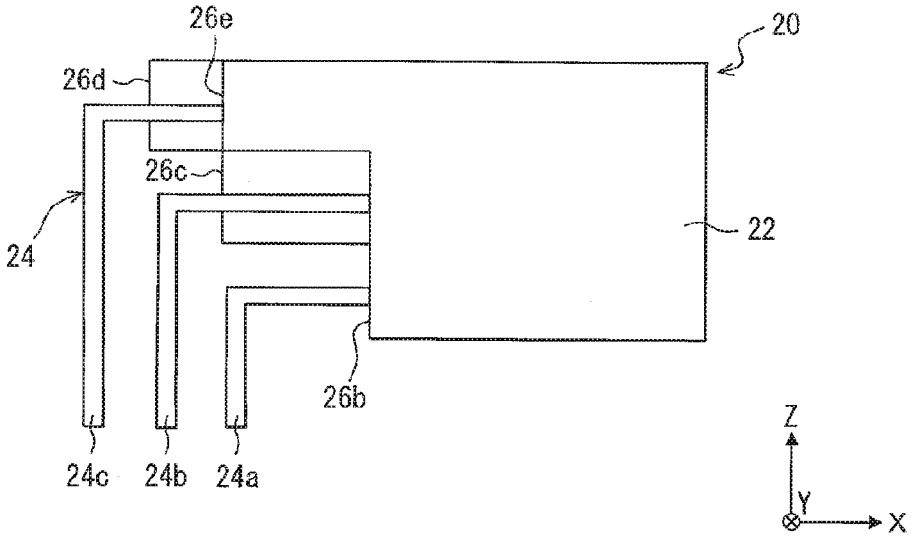
FIG. 7 is a schematic side view showing the detailed structure of the connector, when viewed it in a Y-direction from a right-hand side in FIG. 6.
Figure 8:
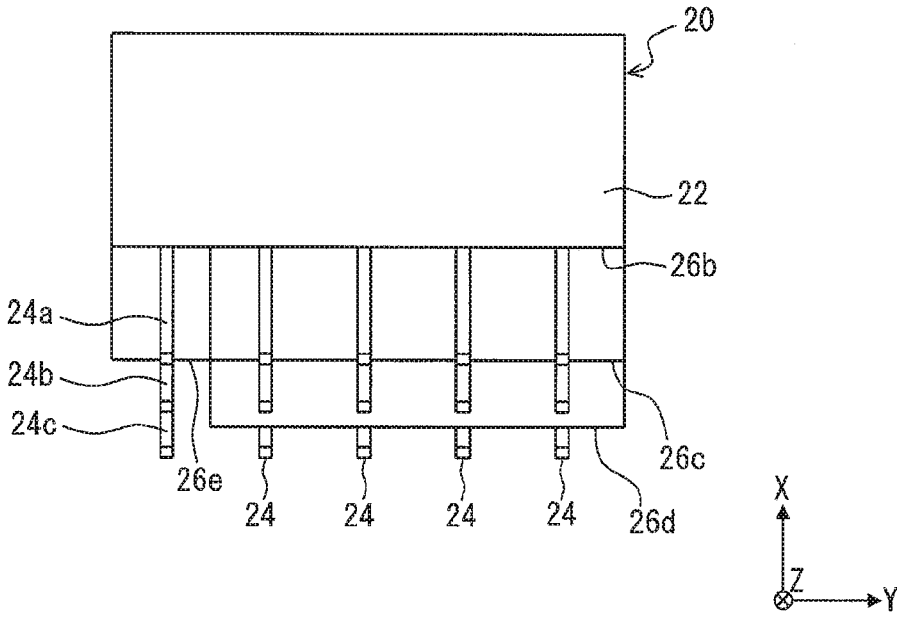
FIG. 8 is a schematic plan view showing the detailed structure of the connector, when viewed it in a Z-direction from an upper-side in FIG. 5.

In the connector housing 22, the first terminal portion 28 of the terminal 24*c* in the first column of the third row group is outwardly extending from the back-side surface of the connector body portion 26, that is, from a fourth step surface 26*e* located on the opposite side to the front-side surface 26*a* in the X-direction. The fourth step surface 26*e* is perpendicular to the X-direction. The fourth step surface 26*e* is located at a position, which is closer to the bent portion 30 of the terminal 24*c* than the first step surface 26*b*. As shown in FIG. 7, the fourth step surface 26*e* is formed at a position, which is on the same plane to that of the second step surface 26*c*. In other words, the fourth step surface 26*e* and the second step surface 26*c* are located at the same position in the X-direction to each other.

In the present embodiment, as shown in FIG. 9, a fourth projecting terminal length of the terminal 24*c* between the fourth step surface 26*e* and the bent portion 30 of the terminal 24*c* is designated by a reference numeral "L4". A fifth projecting terminal length of the terminal 24*b* between the first step surface 26*b* and the bent portion 30 of the terminal 24*b* is designated by a reference numeral "L5". A sixth projecting terminal length of the terminal 24*a* between the first step surface 26*b* and the bent portion 30 of the terminal 24*a* is designated by a reference numeral "L6". In the present embodiment, the fourth projecting terminal length "L4" is made to be smaller than not only the fifth projecting terminal length "L5" but also the sixth projecting terminal length "L6".

On the other hand, the fifth projecting terminal length "L5" is made to be larger than the sixth projecting terminal length "L6". In other words, each of the projecting terminal length is arranged in an order of the fifth projecting terminal length "L5", the sixth projecting terminal length "L6" and the fourth projecting terminal length "L4", in a view point of its length.

In a case that the terminal 24*a* in the first column of the first row group is regarded as the terminal of the first terminal group defined in claim 1, the terminal 24*b* in the first column of the second row group is not included in the meaning of the terminal of the second terminal group defined in claim 1, because the fifth projecting terminal length "L5" of the terminal 24*b* is larger than the sixth projecting terminal length "L6" of the terminal 24*a*. In other words, the connector 20 of the second embodiment includes, among the multiple terminals, such a terminal, which does not correspond to the terminal of the first terminal group or the second terminal group defined in claim 1.

In other words, it is not always necessary in the present disclosure that all of the terminals belonging to the first terminal group and all of the terminals belonging to the second terminal group satisfy should satisfy the condition that the projecting terminal length of each terminal belonging to the second terminal group is equal to or smaller than that of each terminal belonging to the first terminal group.

In the first embodiment, all of the terminals of the first row group outwardly extend from the same first step surface 26*b*, all of the terminals of the second row group outwardly extend from the same second step surface 26*c* and all of the terminals of the third row group outwardly extend from the same third step surface 26*d*. However, in the second embodiment, as explained above, one or some of the terminals belonging to the row group(s) and/or belonging to the column(s) may outwardly extend from the different step surface(s).

Third Embodiment

In a third embodiment of the present disclosure, explanation for those portions of the electronic device 100, which have the same or similar portions and/or structures to those of the first embodiment, will be omitted.

Figure 10:
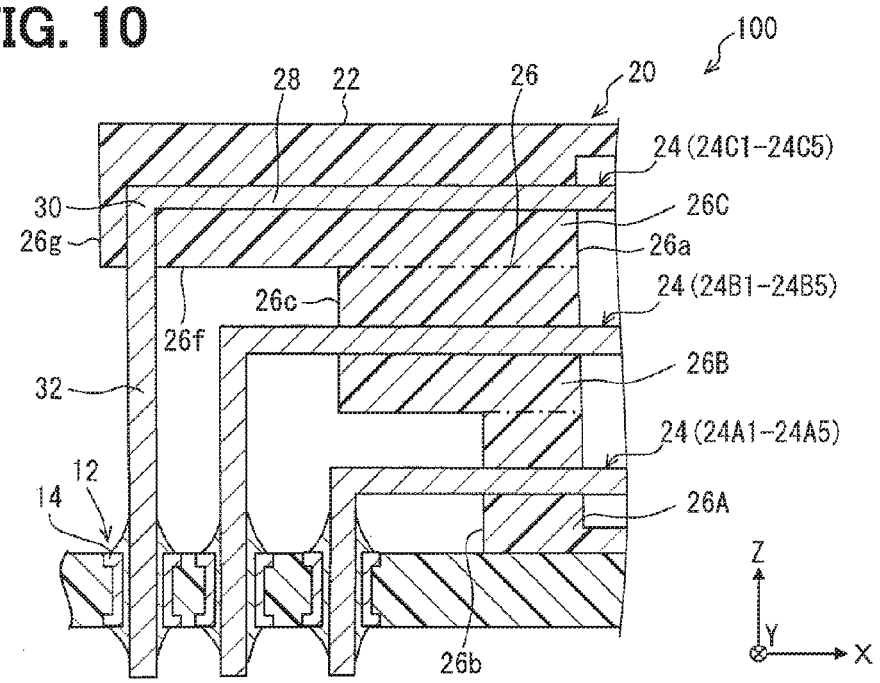
FIG. 10 is an enlarged schematic cross sectional view showing a detailed structure for a connector of an electronic device according to a third embodiment of the present disclosure.

As shown in FIG. 10, a portion of the terminal 24 (24C1-24C5) of the third row group from its middle part to the bent portion 30, that is, the portion corresponding to the inside extending portion of the first terminal portion 28 in the first embodiment, is also supported by the connector body portion 26. The terminal 24 (24C1-24C5) of the third row group corresponds to a terminal located at a position, which is most-separated from the base plate 10 in the Z-direction. The terminal 24 (24C1-24C5) of the third row group is, therefore, also referred to as "a terminal of a top-side row group". The second terminal portion 32 of the terminal 24 (24C1-24C5) of the top-side row group is outwardly extending from a lower side surface 26*f* of the third terminal supporting body 26C of the connector housing 22. The lower side surface 26*f* of the third terminal supporting body is perpendicular to the Z-direction.

A fifth step surface 26*g*, which is a part of the back-side surface formed at the third terminal supporting body 26C of the connector body portion 26 for supporting the terminal 24 (24C1-24C5) of the third row group, is formed at the opposite side of the connector body portion 26 to the front-side surface 26*a* in the X-direction. Therefore, the fifth step surface 26*g* is located at a position, which is more away from the bent portion 30 of the terminal 24 (24C1-24C5) of the third row group in the X-direction (in the opposite direction to the front-side surface 26*a*). Accordingly, the second terminal portion 32 of the terminal 24 (24C1-24C5) of the third row group is not outwardly extending from the fifth step surface 26*g*, which is perpendicular to the X-direction.

The lower side surface 26*f* is connected to the second step surface 26*c* and the fifth step surface 26*g*. The lower side surface 26*f* is located at a position, which is more away from the first step surface 26*h* and the second step surface 26*c* in the X-direction to the bent portion 30 of the terminal 24 (24C1-24C5) of the third row group.

Generally, the terminal 24 (24C1-24C5) of the top-side row group has a longer exposed terminal length than the terminals 24 (24A1-24A5, 24B1-24B5) of the first and the second row groups.

According to the present embodiment, however, the terminal 24 (24C1-24C5) of the top-side row group (more exactly, the first terminal portion 28 including its bent portion 30) is embedded in the connector housing 22. As a result, the component of the exposed terminal length of the terminal 24 (24C1-24C5) in the X-direction can be made zero. Therefore, the exposed terminal length of the terminal 24 (24C1-24C5) of the third embodiment can be made smaller than that of the first or the second embodiment. Therefore, it becomes easier to make the exposed terminal length of the terminal 24 (24C1-24C5) of the top-side row group equal to (or closer to) that of the terminal 24 (24A1-24A5, 24B1-24B5) of the first and/or the second row group.

In the present embodiment, the bent portion 30 of the terminal 24 is embedded in the connector housing 22 only for the terminal 24 (24C1-24C5) of the top-side row group. However, the third embodiment may be also applied to not only the terminal 24 (24C1-24C5) of the top-side row group but also the other terminal 24 (24A1-24A5, 24B1-24B5) of the first or the second row group.

The present disclosure is not limited to the above embodiments but can be further modified in various manners without departing from a spirit of the present disclosure.

In the above embodiments, the connector housing 22 is formed as a separate part from the cover member 60. However, the connector housing 22 may be integrally formed with the cover member 60 as one unit.

In the above embodiments, the terminals 24 are inserted into the base plate 10 and mounted thereto. The terminals 24 may be connected to the base plate 10 by a surface mounting technology. Alternatively, the terminals 24 may be connected to the base plate 10 by a press-fit technology.

In the above embodiments, the multiple terminals 24 are divided into and arranged in three row groups in the Z-direction. The present disclosure can be applied to any other types of the connector, which has multiple terminals divided into and arranged in two row groups or more than three row groups in the Z-direction. In addition, in the above embodiments, the multiple terminals 24 are arranged in five columns in the Y-direction. The present disclosure may be applied to any other types of the connector, which has multiple terminals arranged in less than or more than five columns in the Y-direction.

In the above embodiments, the terminal 24 is formed in the L-letter shape. The present disclosure can be applied to any other types of the terminal, which has a first portion (such as, the first terminal portion 28), the bent portion 30 and a second portion (such as, the second terminal portion 32), wherein each of the first and the second portions is not necessarily formed in a straightly extending form.

In the above embodiments, the second terminal portion 32 is extending in the Z-direction from the bent portion 30 to the base plate 10. It is not always necessary for the second terminal portion 32 to extend in the direction perpendicular to the base plate 10 (in the Z-direction). The second terminal portion 32 may extend from the bent portion 30 to the land 14 of the base plate 10 in any other form. For example, the second terminal portion 32 may be inclined with respect to the upper-side surface 10*a* of the base plate 10.

In the above embodiments, the connector housing 22 is formed in the box shape having the connector body portion 26 and the open end on the side opposite to the connector body portion 26 (at the front side. The connector housing 22 may be formed in a cubic shape.

In the above embodiments, the thickness of the connector body portion 26 in the X-direction varies from the terminal supporting body to the terminal supporting body for the respective terminals arranged in the different row groups in the Z-direction. However, the thickness of the connector body portion 26 may have the same constant thickness in the X-direction for each of the terminal supporting bodies arranged in the Z-direction.

In the above embodiments, the parts and/or components 40 are mounted to the upper-side surface 10*a* of the base plate 10. The parts and/or components 40 may be mounted to both side surfaces 10*a* and 10*b* of the base plate 10.

In the above embodiments, the base plate 10 and the cover member 60 as well as the casing 50 and the cover member 60 are respectively connected to each other by means of the bolts or the like (the screw-fitting). The above components (the base plate, the cover member and the casing) may be connected to each other by any other methods, such as, a caulking, adhesion and so on. The insertion holes 16, the first fixing holes 76 and the second fixing holes 78 may be formed as threaded holes. The screw holes 56 may be formed by simple through-holes without threaded portions.

What is claimed is:

1. An electronic device comprising:

a base plate having multiple lands; and a connector for electrically connecting the base plate to an outside electric device arranged at an outside of the electronic device, wherein the connector has a connector housing and multiple terminals supported by the connector housing, and each one end of the terminals outwardly extends from a side surface of the connector housing and is electrically connected to a corresponding land formed in the base plate, the multiple terminals are arranged in a first direction of the connector housing and the multiple terminals are divided into at least a first terminal group and a second terminal group, which are arranged in a second direction of the connector housing, wherein the second direction is perpendicular to the first direction, each of the terminals has a first terminal portion extending in a third direction of the connector housing, which is perpendicular to the first direction and the second direction, a part of the first terminal portion being supported by the connector housing;

a bent portion connected to an end of the first terminal portion; and a second terminal portion extending from the bent portion to the corresponding land formed in the base plate, the connector housing has a first terminal supporting body for supporting the terminals of the first terminal group and a second terminal supporting body for supporting the terminals of the second terminal group, the first terminal supporting body has a first step surface from which each end of the terminals of the first terminal group outwardly extends, the second terminal supporting body has a second step surface from which each end of the terminals of the second terminal group outwardly extends, and the first step surface is located at a position closer to the base plate in the second direction than the second step surface, the bent portion of the terminal of the second terminal group is located at a position of the third direction, which is more away from the first step surface of the connector housing in the third direction than the bent portion of the terminal of the first terminal group, a second projecting terminal length of the first terminal portion of the terminal of the second terminal group, which outwardly extends in the third direction between the second step surface and the bent portion, is smaller than a first projecting terminal length of the first terminal portion of the terminal of the first terminal group, which outwardly extends in the third direction between the first step surface and the bent portion, and the terminals are collectively structured to mitigate resonance resulting from vibrations.

2. The electronic device according to claim 1, wherein the multiple terminals, which are arranged in the first direction of the connector housing, are divided into multiple terminal groups more than two, so that the multiple terminal groups have a third terminal group in addition to the first and the second terminal groups, wherein the first to the third terminal groups are arranged in the second direction of the connector housing and the third terminal group is located at a position, which is most separated from the base plate in the second direction than the first and the second terminal groups, wherein the connector housing has a third terminal supporting body for supporting the terminals of the third terminal group and the third terminal supporting body has a third step surface, from which each of the terminals of the third terminal group outwardly extends in the same direction to those of the first and the second terminal groups, and wherein a third projecting terminal length of the terminal of the third terminal group between the third step surface and the bent portion is equal to or smaller than the first projecting terminal length of the terminal of the first terminal group and/or the second projecting terminal length of the terminal of the second terminal group.

3. The electronic device according to claim 2, wherein all of the terminals belonging to the first terminal group outwardly extend from the first step surface, all of the terminals belonging to the second terminal group outwardly extend from the second step surface, and all of the terminals belonging to the third terminal group outwardly extend from the third step surface.

4. The electronic device according to claim 2, wherein all of the terminals belonging to the first terminal group outwardly extend from the first step surface, a terminal belonging to the second terminal group outwardly extends from a step surface, which is formed on the same plane to that of the first step surface, and the remaining terminals belonging to the second terminal group outwardly extend from the second step surface, and a terminal belonging to the third terminal group outwardly extends from a step surface, which is formed on the same plane to that of the second step surface, and the remaining terminals belonging to the third terminal group outwardly extend from the third step surface.

5. The electronic device according to claim 1, wherein the multiple terminals, which are arranged in the first direction of the connector housing, are divided into multiple terminal groups more than two, so that the multiple terminal groups have a third terminal group in addition to the first and the second terminal groups, wherein the first to the third terminal groups are arranged in the second direction of the connector housing and the third terminal group is located at a position, which is most separated from the base plate in the second direction than the first and the second terminal groups, wherein the connector housing has a third terminal supporting body for supporting the terminals of the third terminal group, and wherein the first terminal portion including the bent portion of the terminal of the third terminal group is supported by the third terminal supporting body, so that the second terminal portion of the terminal of the third terminal group outwardly extends directly from the third terminal supporting body in a direction perpendicular to the base plate.

6. The electronic device according to claim 1, wherein a second total length of the first terminal portion and the second terminal portion of the second terminal group, which extends from the second step surface to the corresponding land is almost equal to a first total length of the first terminal portion and the second terminal portion of the first terminal group, which extends from the first step surface to the corresponding land.

7. The electronic device according to claim 1, wherein all of the terminals belonging to the first terminal group outwardly extend from the first step surface, and a terminal belonging to the second terminal group outwardly extends from a step surface, which is formed on the same plane to that of the first step surface, and the remaining terminals belonging to the second terminal group outwardly extend from the second step surface.

8. The electronic device according to claim 1, wherein the first terminal portion, the bent portion, and the second terminal portion of each of the terminals project from the connector to be exposed from the connector.

9. A connector for an electronic device, which has a base plate having multiple lands, comprising:

a connector housing; and multiple terminals supported by the connector housing, each one end of the terminals outwardly extending from a side surface of the connector housing and each one end of the terminals being electrically connected to a corresponding land, wherein the multiple terminals are arranged in a first direction of the connector housing and the multiple terminals are divided into at least a first terminal group and a second terminal group, which are arranged in a second direction of the connector housing, wherein the second direction is perpendicular to the first direction, each of the terminals has a first terminal portion extending in a third direction of the connector housing, which is perpendicular to the first direction and the second direction, a part of the first terminal portion being supported by the connector housing;

a bent portion connected to an end of the first terminal portion; and a second terminal portion extending from the bent portion to the corresponding land formed in the base plate, the connector housing has a first terminal supporting body for supporting the terminals of the first terminal group and a second terminal supporting body for supporting the terminals of the second terminal group, the first terminal supporting body has a first step surface from which each of the terminals of the first terminal group outwardly extends, the second terminal supporting body has a second step surface from which each of the terminals of the second terminal group outwardly extends, and the first step surface is located at a position closer to the base plate in the second direction than the second step surface, the bent portion of the terminal of the second terminal group is located at a position of the third direction, which is more away from the connector housing in the third direction than the bent portion of the terminal of the first terminal group, a second projecting terminal length of the first terminal portion of the terminal of the second terminal group, which outwardly extends in the third direction between the second step surface and the bent portion is smaller than a first projecting terminal length of the first terminal portion of the terminal of the first terminal group, which outwardly extends in the third direction between the first step surface and the bent portion, and the terminals are collectively structured to mitigate resonance resulting from vibrations.

10. The connector according to claim 9, wherein the multiple terminals, which are arranged in the first direction of the connector housing, are divided into multiple terminal groups more than two, so that the multiple terminals have a third terminal group in addition to the first and the second terminal groups, wherein the first to the third terminal groups are arranged in the second direction of the connector housing and the third terminal group is located at a position, which is most separated from the base plate in the second direction than the first and the second terminal groups, wherein the connector housing has a third terminal supporting body for supporting the terminals of the third terminal group and the third terminal supporting body has a third step surface, from which each of the terminals of the third terminal group outwardly extends in the same direction to those of the first and the second terminal groups, and wherein a third projecting terminal length of the terminal of the third terminal group between the third step surface and the bent portion is equal to or smaller than the first projecting terminal length of the terminal of the first terminal group and/or the second projecting terminal length of the terminal of the second terminal group.

11. The connector according to claim 9, wherein the multiple terminals, which are arranged in the first direction of the connector housing, are divided into multiple terminal groups more than two, so that the multiple terminals have a third terminal group in addition to the first and the second terminal groups, wherein the first to the third terminal groups are arranged in the second direction of the connector housing and the third terminal group is located at a position, which is most separated from the base plate in the second direction than the first and the second terminal groups, wherein the connector housing has a third terminal supporting body for supporting the terminals of the third terminal group, and wherein the first terminal portion including the bent portion of the terminal of the third terminal group is supported by the third terminal supporting body, so that the second terminal portion of the terminal of the third terminal group outwardly extends directly from the third terminal supporting body in a direction perpendicular to the base plate.

12. The electronic device according to claim 9, wherein a second total length of the first terminal portion and the second terminal portion of the second terminal group, which extends from the second step surface to the corresponding land is almost equal to a first total length of the first terminal portion and the second terminal portion of the first terminal group, which extends from the first step surface to the corresponding land.

13. The electronic device according to claim 9, wherein all of the terminals belonging to the first terminal group outwardly extend from the first step surface, and a terminal belonging to the second terminal group outwardly extends from a step surface, which is formed on the same plane to that of the first step surface, and the remaining terminals belonging to the second terminal group outwardly extend from the second step surface.

14. The electronic device according to claim 9, wherein the first terminal portion, the bent portion, and the second terminal portion of each of the terminals project from the connector to be exposed from the connector.

15. An electronic device comprising:

a base plate having multiple lands; and a connector for electrically connecting the base plate to an outside electric device, wherein the connector has a connector housing and multiple terminals supported by the connector housing, each front-side end of the terminals outwardly extends from a front-side surface of the connector housing and each back-side end of the terminals outwardly extends from a back-side surface of the connector housing in a direction opposite to the front-side surface, and each back-side end of the terminals is electrically connected to a corresponding land formed in the base plate, the multiple terminals are arranged in a width direction of the connector housing and the multiple terminals are divided into at least a first terminal group and a second terminal group, which are arranged in a height direction of the connector housing, wherein the height direction is perpendicular to the width direction, each of the terminals has a first terminal portion extending in a depth direction of the connector housing, which is perpendicular to the width direction and the height direction, a part of the first terminal portion being supported by the connector housing;

a bent portion connected to a back-side end of the first terminal portion; and a second terminal portion extending from the bent portion to the corresponding land formed in the base plate, the connector housing has a first terminal supporting body for supporting the terminals of the first terminal group and a second terminal supporting body for supporting the terminals of the second terminal group, the first terminal supporting body has a first step surface at its back side from which each back-side end of the terminals of the first terminal group outwardly extends, the second terminal supporting body has a second step surface at its back side from which each back-side end of the terminals of the second terminal group outwardly extends, and the first step surface is located at a position closer to the base plate in the height direction than the second step surface, the bent portion of the terminal of the second terminal group is located at a position of the height direction, which is more separated from the base plate in the height direction than the bent portion of the terminal of the first terminal group, the bent portion of the terminal of the second terminal group is located at a position of the depth direction, which is more away from the first step surface of the connector housing in the depth direction than the bent portion of the terminal of the first terminal group, a second projecting terminal length of the first terminal portion of the terminal of the second terminal group, which extends in the third direction between the second step surface and the bent portion, is smaller than a first projecting terminal length of the first terminal portion of the terminal of the first terminal group, which extends in the third direction between the first step surface and the bent portion, and the terminals are collectively structured to mitigate resonance resulting from vibrations.

16. The electronic device according to claim 15, wherein a second total length of the first terminal portion and the second terminal portion of the second terminal group, which extends from the second step surface to the corresponding land is almost equal to a first total length of the first terminal portion and the second terminal portion of the first terminal group, which extends from the first step surface to the corresponding land.

17. The electronic device according to claim 15, wherein all of the terminals belonging to the first terminal group outwardly extend from the first step surface, and a terminal belonging to the second terminal group outwardly extends from a step surface, which is formed on the same plane to that of the first step surface, and the remaining terminals belonging to the second terminal group outwardly extend from the second step surface.

18. The electronic device according to claim 15, wherein the first terminal portion, the bent portion, and the second terminal portion of each of the terminals project from the connector to be exposed from the connector.

* * * * *